United States Patent [19]

Doerner

[11] 3,962,874

[45] June 15, 1976

[54] ROTARY HEAT ENGINE POWERED SINGLE FLUID COOLING AND HEATING APPARATUS

[75] Inventor: William A. Doerner, Wilmington, Del.

[73] Assignee: E. I. Du Pont de Nemours and Company, Wilmington, Del.

[22] Filed: Mar. 12, 1975

[21] Appl. No.: 557,875

Related U.S. Application Data

[63] Continuation-in-part of Ser. No. 316,851, Jan. 2, 1973, abandoned, which is a continuation-in-part of Ser. No. 277,902, Feb. 22, 1972, abandoned.

[52] U.S. Cl. ..... 60/669; 62/325; 62/499; 165/86; 122/11

[51] Int. Cl.[2] ..... F25B 3/00; F01K 11/04

[58] Field of Search ..... 62/324, 325, 499; 165/29, 86, 87, 88; 122/11; 60/669

[56] References Cited

UNITED STATES PATENTS

| | | | |
|---|---|---|---|
| 2,811,841 | 5/1957 | Grimshaw | 62/499 |
| 3,001,384 | 9/1961 | Hanson et al. | 62/499 |
| 3,773,106 | 11/1973 | Levy | 165/86 |
| 3,877,515 | 4/1975 | Laing | 165/86 |

*Primary Examiner*—William O'Dea
*Assistant Examiner*—Ronald C. Capossela

[57] ABSTRACT

Rotary closed Rankine cycle cooling and heating apparatus utilizing a single fluid for both engine power and refrigeration. The apparatus includes a rotary housing containing a boiler, power fluid expander coupled with a refrigerant fluid compressor and a refrigerant expander. A condenser for the expanded power portion and the compressed refrigerant portion of the single fluid, and an evaporator for the expanded refrigerant fluid portion, are mounted at respectively opposite sides of the housing coaxially thereof for rotation with the housing as a unit. The power fluid expander is driven at a predetermined speed by pressure power fluid vapor generated in the boiler and in turn drives the refrigerant fluid compressor. The refrigerant expander is of the capillary type constructed and arranged with respect to the evaporator to automatically control the capacity balance of the refrigerant system. The entire unit is hermetically sealed and the Rankine cycle power system is adapted and designed for use with a high molecular weight fluid. The expanded power and compressed refrigerant portions of the single fluid are condensed in the condenser and means are provided in the housing for dividing and supplying the condensed liquid to the boiler at the rate to maintain a constant predetermined liquid level in the boiler and to the refrigerant expander to establish and maintain capacity balance in the refrigerant system.

16 Claims, 8 Drawing Figures

(SUMMER OPERATION)

(WINTER OPERATION)

ROTARY HEAT ENGINE POWERED SINGLE FLUID COOLING AND HEATING APPARATUS

This application is a continuation-in-part of my application Ser. No. 316,851, filed Jan. 2, 1973, now abandoned, which is a continuation-in-part of my earlier application Ser. No. 277,902 filed Feb. 22, 1972, now abandoned.

This invention relates to rotary heat engine powered single fluid cooling and heating apparatus, and more particularly to closed Rankine cycle engine powered single fluid apparatus having a condenser and evaporator coupled to the engine for rotation therewith as a unit.

An object of the present invention is to provide a rotary closed Rankine cycle engine powered single fluid cooling and heating apparatus that is of compact, unitary construction and both quiet and efficient in operation, Another object of the invention is to provide a rotary engine powered single fluid apparatus of the type described that is hermetically sealed and does not require high speed seals for separating portions of the apparatus operating at different pressures.

Another object of the invention is to provide a rotary engine powered refrigeration apparatus as described which utilizes a single fluid for both engine power and refrigeration.

Another object of the invention is to provide a rotary engine powered single fluid apparatus of the character set forth that is operable to function either as a space cooler or heater as desired and the rotary condenser and evaporator function also as blowers for circulating the cooling or heating fluid independently of other power sources.

Another object of the invention is to provide a refrigeration apparatus embodying the features set forth that can be manufactured and shipped fully assembled, hermetically sealed and charged with the single refrigerant and power fluid.

These and other objects of the invention and the various features and details of the construction and operation thereof are hereinafter set forth and described with reference to the accompanying drawings, in which.

Figure 1:
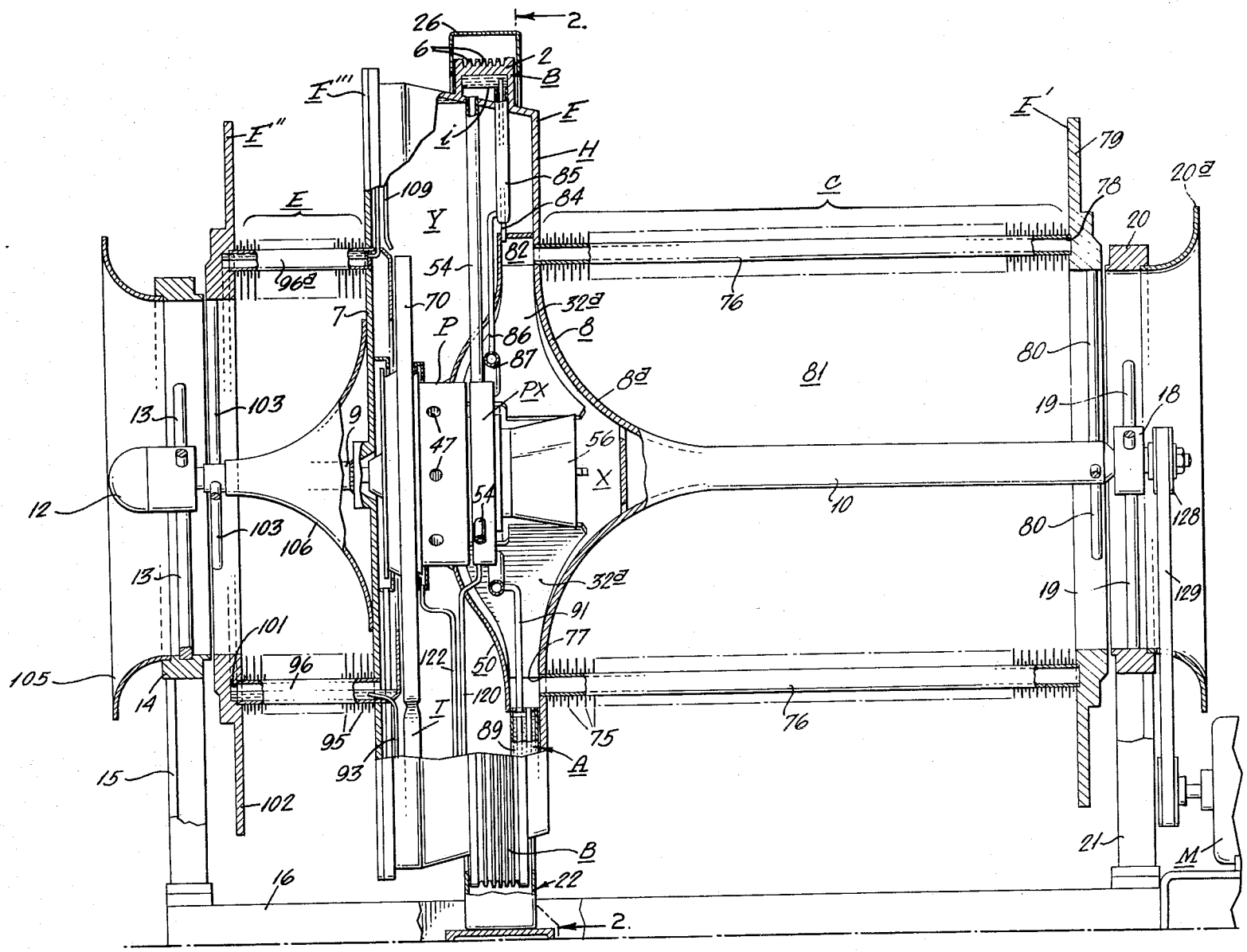
FIG. 1 is a typical sectional view diametrically through a rotary heat engine powered apparatus embodying the present invention utilizing a single fluid for the boiler power fluid and the refrigerant.

Referring to the drawings, the illustrated embodiment of rotary engine powered single fluid cooling and heating apparatus according to the present invention comprises a rotary closed Rankine cycle engine including a boiler B and boiler fluid expander PX together with a compressor P, expander RX and evaporator E for the refrigerant component of the single fluid, and a condenser C for both the power and refrigerant portions of the single fluid. The components are mounted on a common axis with the condenser C and evaporator E axially spaced at opposite sides of the boiler B, expander PX, compressor P and expander RX which are compactly arranged therebetween in a coaxial housing H.

The boiler B, condenser C and evaporator E are mounted for coaxial rotation together as a unit. The boiler pressure fluid expander PX is driven at a predetermined speed by the pressure power fluid generated by the boiler B and in turn drives the compressor P and an internal occluded fixed-ratio gear train that is connected to the boiler-condenser-evaporator unit to rotationally drive the latter at a predetermined lesser speed. The entire unit is hermetically sealed and a pendulum restrained torque anchor T is provided for the gear train. The closed Rankine cycle power engine is adapted and designed for use with high molecular weight fluids and the same high molecular weight fluid is used for both the boiler power fluid and the refrigerant.

Figure 3:
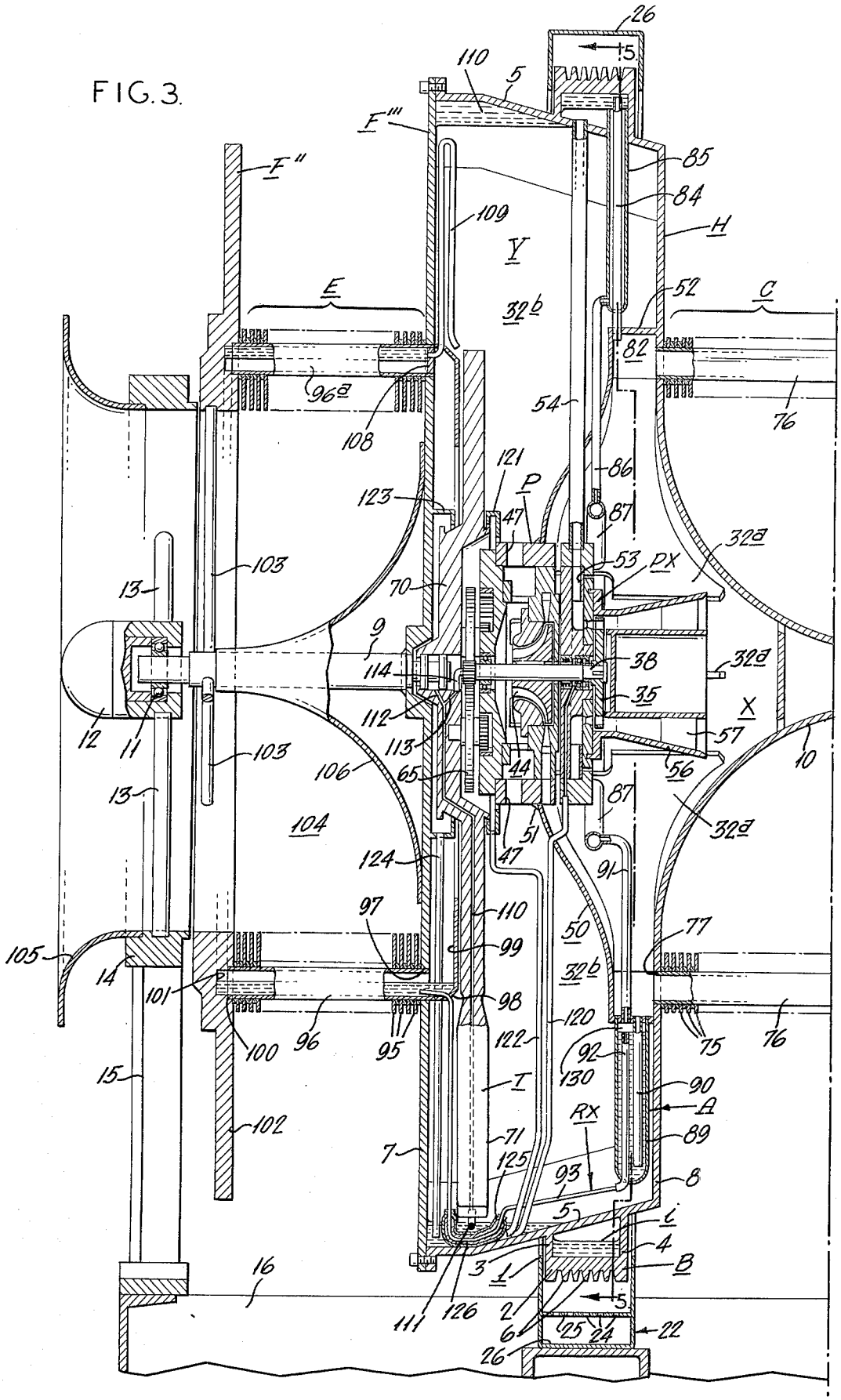
FIG. 3 is an enlarged fragmentary vertical sectional view diametrically through the rotary heat engine embodying the present invention.
Figure 5:
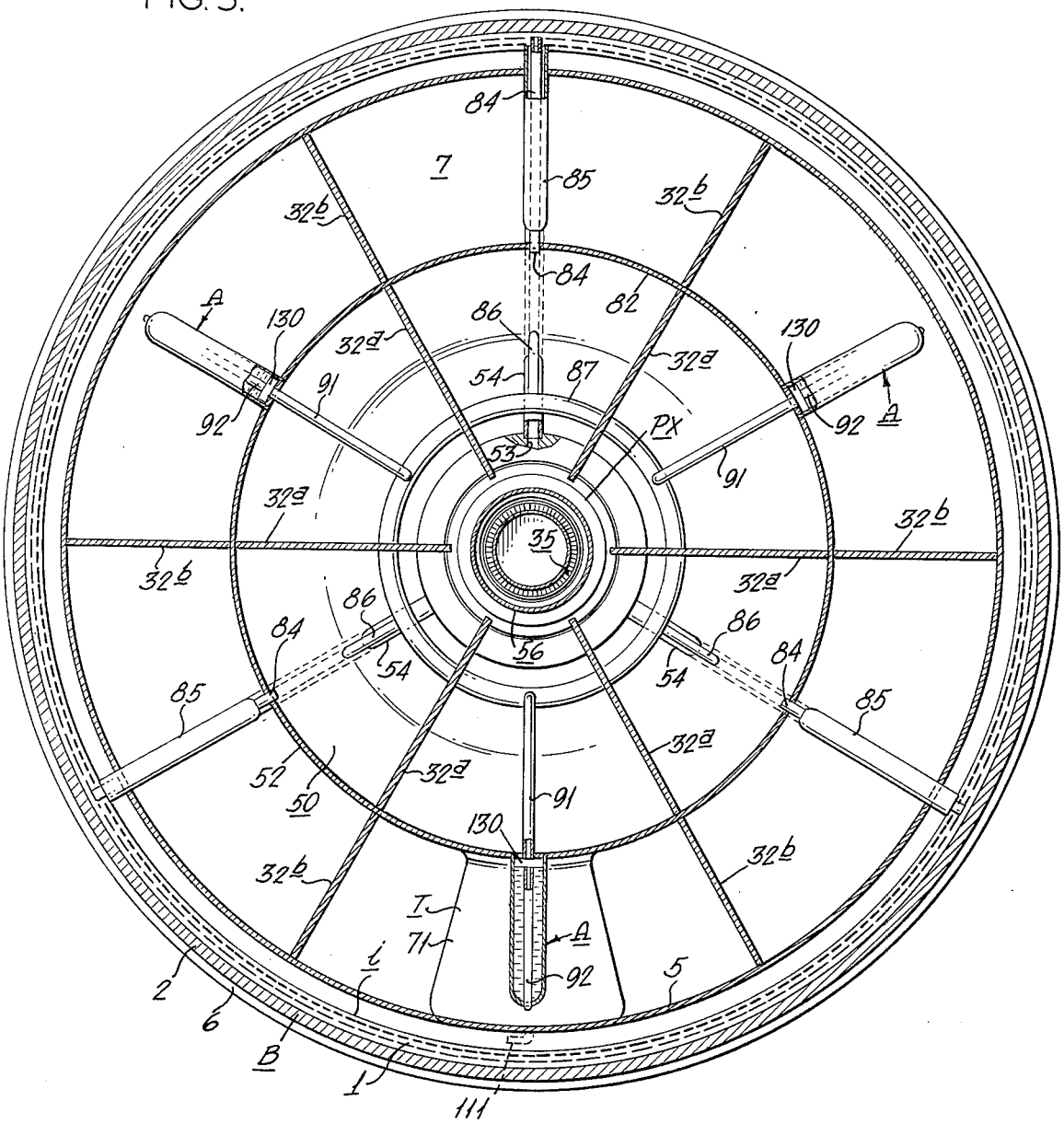
FIG. 5 is a sectional view on lines 5—5, FIG. 3.

In the embodiment of the invention shown in the drawings and with reference particularly to FIG. 3 thereof, the rotary boiler B is formed integral with the coaxial engine housing H and comprises a cylindrical annular chamber 1 circumscribing the housing H and defined by an outer continuous circumferentially extending wall 2, side walls 3 and 4 and an inner continuous wall 5, the latter constituting the peripheral wall of the engine housing H. Preferably the outer circumferential wall 2 of the boiler is provided with circumferential fins 6, as shown, to increase thermal conductivity therethrough, or the wall 2 may be configurated or contoured to provide an expanded or extended thermal conductive surface area in accordance with the invention disclosed in U.S. Pat. No. 3,690,302 issued Sept. 12, 1972.

In addition to the peripheral wall 5, the engine housing H comprises axially spaced side wall portions 7 and 8, respectively. The engine housing H and boiler B are mounted for rotation about their common axis by means of a shaft 9 secured to and extending coaxially outward from the housing side wall 7 and a tubular shaft 10 that is formed as an integral part of the housing side wall 8. The outer end of the shaft 9 is journalled by means of a bearing 11 in a stationary hub 12 that is fixedly supported by means of radial spokes 13 from a circumscribing concentric ring 14 that in turn is fixedly supported by a standard 15 from a fixed base or support 16 of the machine. In similar manner, and as best shown in FIG. 1 of the drawings, the outer end of the shaft 10 is rotatably journalled by means of a bearing in a stationary collar or ring 18 that is supported by means of radial spokes 19 within a circumscribing concentric ring 20 that is in turn fixedly supported by a standard 21 from the fixed base 16 of the machine. From the foregoing, it will be apparent that the cylindrical boiler B and engine housing H together with the shafts 9 and 10, constitute a unitary structure that is rotatably mounted for coaxial rotation as a unit about the engine axis.

The rotary housing and boiler are adapted to be driven about their axis at a predetermined speed of rotation calculated to create the centrifugal force necessary to dispose and maintain the selected boiler liquid therein uniformly distributed circumferentially about and in contact with the inner surface of the outer peripheral wall 2 of the boiler with a liquid/vapor interface, designated *i* in FIG. 3, that is highly stable and essentially cylindrical and concentric with the axis of rotation with the boiler. Essentially the liquid/vapor interface *i* is disposed at a predetermined radius from the rotation axis of the boiler to provide high boiling heat fluxes in excess of those obtainable at ambient gravity.

Figure 2:
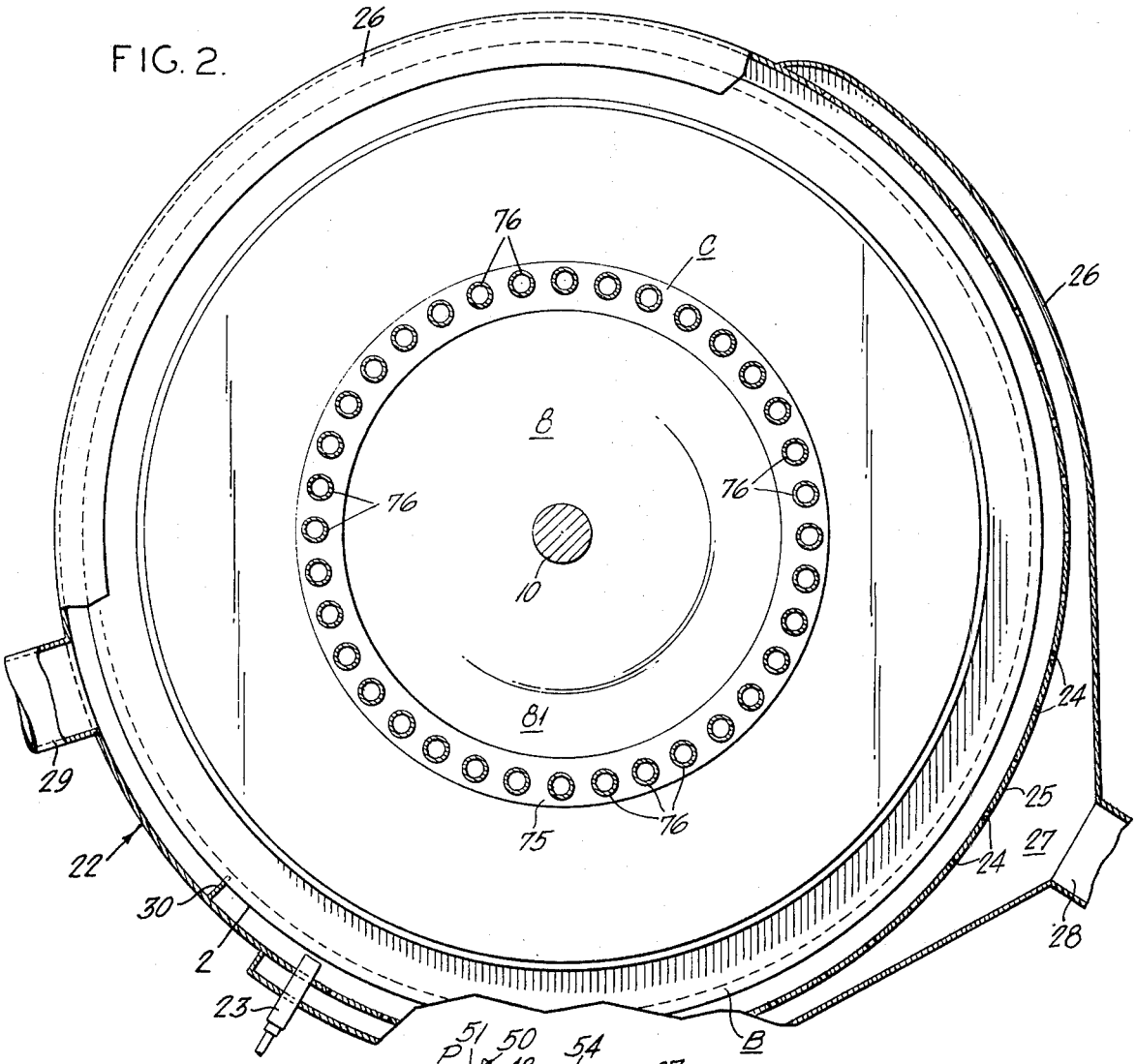
FIG. 2 is a transverse sectional view on line 2—2, FIG. 1.

Referring to FIGS. 2 and 3, the annular body of liquid in the boiler may be heated to the required boiling temperature to vaporize the same, for example, by the combustion of a suitable fuel-air mixture in a stationary combustion box 22 that circumscribes the rotatable boiler chamber 1. Fuel for combustion is discharged into the combustion box 22 from a with the fuel is discharged into the combustion box through a plurality of ports 24 in the peripheral wall 25. A hood structure 26 defines a plenum chamber 27 into which the air is supplied through a duct 28 at the pressure and volume required for efficient combustion of the fuel to heat the liquid in the boiler casing to the desired temperature. The residual combustion gases are discharged through an exhaust duct 29, and a stationary transverse baffle 30 configurated for complementary interfitting cooperation with the configuration of the boiler peripheral wall 2, is mounted intermediate the fuel nozzle 23 and exhaust duct 29 to control recirculation of the combustion gases.

The invention is not limited to the particular boiler and combustor shown and described and alternative constructions may be provided such as, for example, disclosed in my U.S. Pat. No. 3,850,147 issued Nov. 26, 1974, or heat such as hot air may be supplied from an external source.

Figure 4:
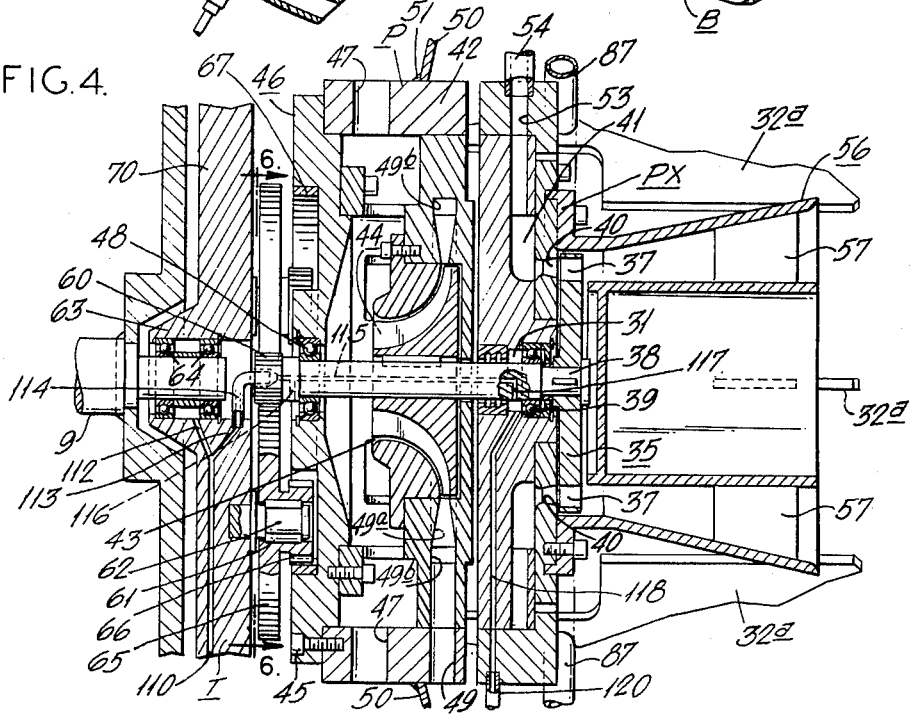
FIG. 4 is an enlarged fragmentary vertical sectional view diametrically through the central hub portion of the rotary heat engine.

Coaxially mounted within the engine housing H for rotation with the latter is the annular power fluid expander PX having a central bore 31 extending coaxially therethrough, as best shown in FIG. 4. The expander PX is fixedly supported coaxially within the engine housing H by means of a plurality of radially disposed vanes 32*a* equally spaced circumferentially within the engine housing H and fixedly secured at their inner and outer edges to the expander PX and engine housing wall 8, respectively, for example by welding.

Referring to FIGS. 3 and 4 of the drawings, the boiler pressure fluid vapor expander PX is in the form of a single-stage shrouded turbine comprising a rotor 35 having a series of turbine blades 37 arranged peripherally thereabout. The turbine rotor 35 is mounted for coaxial rotation independently of the boiler B and engine housing H on a shaft 38 that is rotatably mounted within the bore 31 of the expander PX by means of a bearing 39. An annular series of nozzles 40 is provided in the power fluid expander PX coaxially adjacent the turbine rotor 35 and in confronting relation to the blades 37 thereof. An annular high pressure manifold 41 is provided in the expander PX and opens to the turbine nozzles 40.

Also mounted within the engine housing H coaxially adjacent the power fluid expander PX is a compressor or pump P for the refrigerant portion of the single fluid. The compressor P comprises an annular housing structure 42 that is fixedly supported within the rotary engine housing H by means of radial vanes 39*b*, so that the compressor housing 42 rotates coaxially as a unit with the engine housing H and boiler B. As best shown in FIG. 4 of the drawings, the compressor housing structure 42 defines interiorly thereof a coaxial annular chamber 43 in which is mounted a compressor rotor 44 that is keyed to the turbine shaft 38 to be driven thereby. Fixedly secured coaxially to the outer side of the compressor housing 42, for example by bolts 45, is an annular plate 46 that cooperates with the compressor housing 42 to define a plurality of circumferentially spaced radial inlet passages 47 to the compressor rotor 44. The turbine shaft 38 extends coaxially through the plate 46 and is journalled therein by a bearing 48. Refrigerant fluid entering the compressor through passages 47 is compressed by the rotor 44 and then discharged through an annular diffuser 49*a*, manifold 49*b* and a plurality of radial passages 49 to the high pressure compartment of the housing now to be described.

Referring to FIG. 3, the interior of the engine housing H is subdivided into two separate high and low pressure compartments X and Y, respectively, by means of an annular dish-shaped partition 50 that is interposed between the radial support vanes 32*a* and 32*b* previously described and secured thereto, for example, by welding or the like. The inner peripheral edge of the partition 50 continuously circumscribes and is welded or otherwise secured in fluid-tight relation to the outer peripheral surface of the compressor P intermediate the compressor inlet passages 47 and discharge passages 49, as shown at 51. The outer peripheral portion of the partition 50 is formed to provide a continuous axially extending rim portion 52 that abuts and is also welded or otherwise secured in fluid-right relation to the inner surface of the housing wall 8 a short distance radially outward of the inner ends of the annular series of the heat exchange tubes of the condenser C, hereinafter described.

High pressure vapor is supplied from the boiler chamber 1 to the manifold 41 through a plurality of radial ports or passages 53 and a corresponding plurality of radially disposed vapor tubes 54 arranged in equally spaced relation circumferentially of the axis to insure rotational balance. Thus the high pressure vapor generated in the boiler chamber 1 passes fomr the latter through the tubes 54 and passages 53 to the high pressure manifold 51 from which it is discharged through the turbine nozzles 40 and impinges upon the blades 37 to drive the turbine rotor 35 and its shaft 38 at the desired speed of rotation. A seal 55, such as a no-contact labyrinth seal, is provided on the turbine shaft 38 inwardly adjacent the bearing 39 to minimize migration of the vapor from the turbine along the shaft 38.

An annular diffuser 56 is flixedly mounted coaxially adjacent the turbine rotor 35 to receive the exhaust vapor from the expander, and the inlet opening thereto is disposed in confronting relation to the turbine blades 37 at opposide sides thereof from the nozzles 40. Exhaust vapor is discharged from the diffuser 56 into the high pressure compartment X of the engine housing H from which it passes into the condenser C as hereinafter described. A plurality of axially extending radial partitions 57 are provided in the diffuser 56 and these, together with the radial vanes 32*a* previously described, function to maintain the angular velocity of the exhaust vapor the same as that of the rotating boiler and housing unit As previously stated, the boiler B, housing H, condenser C and evaporator E are mounted for coaxial rotation together as a unit, and in accordance with the present invention a mechanical coupling is provided between the expander PX and the boiler-condenser-evaporator unit so that during operation of the machine, after start-up, the unit is rotationally driven continuously by the primary power output generated by the engine. This is accomplished by means of an internal occluded fixed-ratio gear train arranged coaxially, of the machine and interiorly of the engine housing H, for example, similar to that shown and described in U.S. Pat. No. 3,769,796 issued Nov. 6, 1973.

Figure 6:
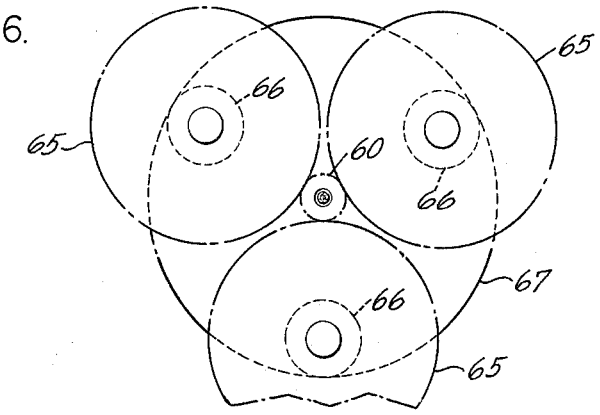
FIG. 6 is a schematic view on line 6—6, FIG. 4 of the fixed-ratio gear train.

In the embodiment of the invention shown in the drawings, and with particular reference to FIGS. 4 and 6, the gear train is in the form of a planetary gear system comprising a sun gear 60 fixedly mounted on and driven by the turbine shaft 38. The driven sun gear 60 drives a plurality of compound gears each rotatably mounted by means of needle bearings 61 on a stub shaft 62 that is fixedly mounted in the adjacent portion of a non-rotating torque anchor member T having a coaxially disposed central hub portion 63 that is journalled on the inner end of the engine shaft 9 by means of pairs of bearings 64. As shown, the sun gear 60 is meshed with and rotationally drives the larger diameter gear 65 of each compound gear and the smaller diameter gear 66 of each compound gear is meshed with and drives a coaxial annular ring gear 67 recessed within and carried by the plate 46 of the compressor housing 42.

The torque anchor T includes a central portion 70 coaxially disposed outwardly adjacent the gear train, for example as shown in FIG. 3 of the drawings, and a pendulum element 71 that depends radially outward from the central portion 70 thereof. The pendulum 71 is of predetermined density, dimensions and location to generate the desired counterforce to oppose the external reaction torque of the air drag in the condenser and evaporator and provide a counter-torque force sufficient to hold the torque anchor T stationary and prevent rotation thereof.

By reason of the non-rotating torque anchor T the compound planetary gears are fixedly positioned so that their axes do not rotate or move circumferentially relative to or about the engine axis. Thus the balance of the power output of the engine expander PX not used to drive the compressor rotor 44 is transmitted from the driving sun gear 60 through the compound planetary gears directly to the driven ring gear 67 on the rotary boiler-condenser-evaporator unit thereby rotationally driving said unit at the fixed speed of the particular gear train.

As previously stated, the exhaust vapor component of the single fluid is discharged from the turbine diffuser 56 into the high pressure compartment X of the housing H and enters the rotary condenser C where it is condensed, and the compressed refrigerant component of the fluid is discharged from the compressor P to said high pressure compartment X and is also condensed in the condenser C. In the illustrated embodiment of the invention shown in FIGS. 1 and 3, the rotary condenser C comprises a coaxial array of annular radial fins 75 and axially extending heat exchange tubes 76 arranged in circumferentially spaced relation about the engine shaft 10 and mounted to rotate with the engine housing H and boiler B as a unit. The fins 75 consist of separate or independent annular disk elements supported and secured in predetermined equally spaced parallel relation with respect to one another by means of the heat exchange tubes 76 that extend longitudinally through the fins 75. The fins 75 and tubes 76 are fabricated of metal having high thermal conductivity such as, for example, copper or aluminum, and said fins preferably are bonded to the heat exchange tubes by brazing, soldering, or the like to provide maximum thermal conductivity therebetween.

The heat exchange tubes 76 are arranged in rotationally balanced eqally spaced relation circumferentially of the fins 75, and about shaft 10, for example, as shown in FIG. 2 of the drawings. In accordance with the present invention, the heat exchange tubes 76 of the condenser C operate to condense the vapor fluid component exhausted from the diffuser 56 and compressed refrigerant fluid component discharged by the compressor P.

To this end, as shown in FIG. 3, the inner ends of the tubes 76 are mounted and secured in corresponding openings 77 provided in the adjacnet engine housing wall 8 so that the interiors of the tubes 76 are in communication with the interior of the adjacent engine compartment X of the housing H. As shown in FIG. 1, the outer ends of the tubes 76 are mounted and secured in recesses 78 provided in an annular end ring 79 that is disposed coaxially adjacent the outermost of the fins 75 and supported from the engine shaft 10 by circumferentially spaced radial spokes 80.

The inner peripheral edges of the fins 75 define internally thereof a coaxial inlet chamber 81 for the cooling fluid to be discharged outwardly by and between the plurality of rotating fins as hereinafter set forth. The inner diameters of the ring 20 and ring 79 are the same as the inner diameter of the adjacent group of fins 75 so as not to restrict the flow of fluid inwardly to the chamber 81, and an outwardly flared or bell-shaped fluid intake member **20*a* is fixedly mounted on the ring 20 in coaxial relation outwardly adjacent the inlet end of the chamber 81. The central portion of the engine housing wall 8 adjacent the shaft 10 is of curved, generally conical shape as indicated at 8*a* for streamlining flow of the heat exchange fluid through the chamber 81 to the fins 75** of the condenser.

The axial length of the condenser C and the spacing or distance between the adjacent fins 75 is determined with relation to the rotational speed at which the boiler-condenser-evaporator unit is driven and to the kinematic viscosity of the cooling fluid to provide a Taylor number in the range of about 5 to 10, preferably about 6, and the inner radius and outer radius of the fins are determined to provide a ratio of inner to outer radii of the fins 75 in the range of about 0.70 to 0.85, preferably about 0.77, as described in my U.S. Pat. No. 3,866,668 issued Feb. 18, 1975. By this construction the viscous properties of the cooling fluid and the shear forces exerted thereon by the rotating fins 75 are utilized to convey and accelerate the fluid radially outward between said fins substantially to the velocity providing optimum total heat exchange between the fluids in the tubes 76 and the fluid passing between the fins 75.

The outer peripheral portion of both the housing wall 8 and the ring 79 extend radially outward beyond the fins 75 a distance to provide annular radial flange portions F and F′, respectively, that operate to augment fluid flow outwardly between the fins 75 as described in U.S. Pat. No. 3,773,106 issued Nov. 20, 1973. Also, axial fluid flow augmentation blades of the type and construction shown and described in said U.S. Pat. No. 3,773,106 can be provided between the flange portions F and F′ when desired in any particular engine installation.

As shown in FIG. 3, the outer rim portion 52 of the housing partition 50 cooperates with the inner surface of the housing wall 8 to define an annular condensate collection chamber 82, for the fluid that is condensed in the heat exchange tubes 76 of the condenser C by heat exchange with a cooling fluid, such as ambient air, discharged outwardly between the array of fins 75 as previously described. The condensate thus formed in the tubes 76 flows inwardly therein and is discharged from the inner ends of said tubes into the annular collection chamber 82. Since the same fluid is employed for both refrigeration and engine power purposes, the liquid condensed in the tubes 76 and collected in the annular chamber 82 is split or divided and conducted in predetermined proportions to the boiler and to the refrigerant expander RX, respectively, as hereinafter described.

The power fluid portion of the condensate collected in the chamber 82 is returned to the boiler B by a plurality of circumferentially equally spaced radial tubes 84 connected between the chamber 82 and boiler 1. Each of the tubes 84 has its outer end immersed in the annular body of liquid in the boiler B and its inner end is spaced a short distance inwardly from the circumferential wall of the collector ring as shown in FIG. 3. Each of the boiler feed tubes 84 is enclosed within a concentric circumscribing sensor tube 85 of greater diameter than said tubes 84. The inner ends of the sensor tubes 85 are enclosed and sealed about the tubes 84 and the outer ends of said sensor tubes 85 are open and disposed at the desired operating liquid level *i* of the liquid in the boiler B. These sensor tubes 85 function as described in my U.S. Pat. No. 3,590,786 issued July 6, 1971, to maintain the liquid level *i* in the boiler B.

The inner end of each sensor tube 85 is connected by means of a radial tube 86 to an annular manifold ring 87. In the embodiment of the invention shown, the ring 87 is of circular cross-section shape and circumscribes the boiler fluid expander PX in radially spaced relation thereto.

The refrigerant portion of the liquid condensate collected in the chamber 82 is supplied to the expander RX by means of a plurality of radially disposed circumferentially equally spaced feed assemblies A. As shown, each feed assembly A comprises a radially disposed thimble 89 that is closed at its outer end and has its inner end secured in fluid-tight relation to the outer circumferential surface of the outer rim portion 52 of the partition 50.

A radial tube 90 in each thimble 89 has its inner end secured in the circumferential rim 52 of the partition 50 in communication with the annular collection chamber 82 to admit liquid condensate from the chamber 82 to the thimbles 89, the outer ends of the tubes 90 terminating short of outer ends of the thimbles 89 as shown. A connection is also provided between each thimble 89 and the annular manifold ring 87 by means of a radial tube 91 that is operable under certain operation conditions of the boiler to permit high pressure boiler vapor to flow radially inward through the sensor tubes 85 to the manifold ring 87 and thence to said thimbles 89 where it is cooled and condensed.

Extending radially inward within each thimble 89 is a tube 92 for supplying liquid to the refrigerant expander RX. The inner ends of the supply tubes 92 terminate in predetermined radially spaced relation to the outer surface of the partition rim 52 of the collection chamber 82 and the outer ends of said tubes 92 extend through the outer end walls of the thimbles 89 and are connected to the inlet ends of a corresponding plurality of capillary tubes 93 comprising the refrigerant expander RX. From the supply tubes 92, the capillary tubes 93 extend generally laterally within the housing H in radially spaced relation to the pendulum 71 of the torque anchor T and then radially inward to the evaporator E to discharge expanded refrigerant thereto where the liquid portion is vaporized. by heat exchange with another fluid, such as ambient air.

In the illustrated embodiment of the invention, the evaporator E is generally similar in construction to the condenser C previously described, and comprises a coaxial array of annular radial fins 95 and axially extending heat exchange tubes 96 arranged in circumferentially spaced relation about the engine shaft 9 and mounted for rotation with the engine housing H, boiler B and condenser C as a unit.

The inner ends of the tubes 96 are mounted and secured in corresponding openings 97 provided in the adjacent engine housing wall 7 so that the interiors of the tubes 96 are in communication with the adjacent low pressure compartment Y of the engine housing H. An annular collecting ring 98 having an inwardly projecting lip 99 circumscribes the inner ends of the tubes 96. The outer ends of the tubes 96 are mounted and secured in recesses 100 and interconnected by an annular manifold 101 provided in an annular end ring 102 that is disposed coaxially adjacent the outermost of the fins 95 and supported from the engine shaft 9 by circumferentially spaced radial spokes 103.

Referring to FIGS. 1 and 3 of the drawings, the inner peripheral edges of the fins 95 define interiorly thereof a coaxial inlet chamber 104 for the heat exchange fluid to be discharged outwardly by and between the plurality of rotating fins 95 in the manner previously described in connection with the condenser C. The inner diameters of the ring 102 and the outwardly adjacent ring 14 are the same as the inner diameter of the fins 95 so as not to restrict the flow of fluid into the chamber 104 and an outwardly flared or bell-shaped intake member 105 is fixedly mounted on the ring 14 in coaxial relation outwardly adjacent the inlet end of the chamber 104. A curved, generally conical shaped cowl 106 surrounds the engine shaft 9 for streamlining flow of the heat exchange fluid through chamber 104 to the array of fins 95 of the evaporator E.

Also, as in the condenser C, the outer peripheral portions of both the adjacent housing wall 7 and the ring 102 extend radially outwardly beyond the fins 95 a distance to provide annular radial flange portions F″ and F‴ that operate to augment fluid flow outwardly between the fins, and axial fluid flow augmentation blades can be provided between the flange portions F″ and F‴ when desired, as previously described.

As in the case of the condenser C the axial length of the evaporator E and the spacing or distance between the adjacent fins 95 is determined with relation to the rotational speed of the evaporator and to the inner and outer radii of said fins 95 so as to utilize the viscous properties of the fluid and the shear forces exerted thereon by the fins to convey and accelerate the fluid radially outward between the fins substantially to the velocity providing optimum total heat exchange between the fluid discharged through the fins 95 and the refrigerant in the tubes 96.

With more particular reference to the refrigerant expander RX, the length and internal diameter of the capillary tubes 93 are correlated to each other and to the number of tubes employed to match the refrigerant flow rate in the capillary expander tubes to the refrigerant flow rate through the compressor. This correlation is critical and can be determined precisely for each installation of the apparatus by a person skilled in the art of refrigeration. In the present invention the capillary expanders 93 and the evaporator E are constructed and arranged so that the refrigerant flow rate in the capillary expander tubes 93 is automatically adjusted according to the refrigerant flow rate through the compressor P to thereby maintain the capacity balance of the refrigerant system.

While it is preferred, in the case of high boiling point refrigerants, that the liquid level in the evaporator tubes 96 be at a greater radial distance from the rotation axis of the apparatus than the radial distance of the refrigerant condenser tubes 76, this is not necessary in the case of lower boiling point refrigerants and with some such refrigerants the evaporation tubes 96 may be at a less radial distance from the axis than the condenser tubes 76. In either arrangement the flow rate of refrigerant through the capillary expander tubes 93 is controlled by the pressure drop across the capillary expander tubes 93 which is determined not only by the difference between the pressure of the vapor at the refrigerant chamber 82 and that of the vapor at the evaporator collector ring 98, but also by the difference between the liquid level *r* in the radially extending tubes 92 adjacent the collection chamber 82 and the liquid level in the evaporator tubes 96.

Thus, when the compressor P delivers refrigerant at a high flow rate, the liquid level *r* in the radial tubes 92 will move radially inward therein to provide the additional pressure necessary to drive the refrigerant through the capillary expander tubes 93 at the proper matching flow rate in relation to the delivery flow of the compressor P. Due to the amplifying effect of the centrifugal force created by rotation of the housing-condenser-evaporator unit, small variations in the liquid level *r* will compensate for wide variations in the flow rate of the refrigerant and the described arrangement of capillary expander and evaporator is operable to provide a capacity balanced system for any refrigerant flow rate from the designed flow rate of the particular apparatus to zero flow of the refrigerant.

The expanded refrigerant is discharged from each of the capillary tubes 93 into the inner end of the proximate evaporator tubes 96, except a few thereof, for example, two, designated 96*a*. The refrigerant entering the tubes 96 is vaporized therein by heat exchange with a fluid, such as ambient air, discharged outwardly between the array of fins 95 as previously described, and the vaporized refrigerant flows inwardly and is discharged from the inner ends of the tubes 96 into the adjacent low pressure compartment Y in the engine housing H. From the compartment Y the evaporated refrigerant reenters the compressor P through the inlet passages 47 where it is again compressed and discharged by the rotor 44 to the condenser C, as previously described.

The two tubes 96*a* that the refrigerant does not enter are disposed diametrically 180° apart and refrigerant is prevented from entering said tubes 96*a* by closure plugs 108 that are disposed in the inner open ends of said two tubes 96*a* as shown in FIG. 3 of the drawings. The apparatus disclosed embodies a force feed lubrication system hereinafter described and the two evaporator tubes 96*a* function to collect and return to the housing compartment Y any lubricant which migrates into the refrigerant fluid portion. Any lubricant that migrates into the refrigerant system will not evaporate in the tubes 96 but will flow through the manifold 101 and collect in the two diametrically opposed tubes 96*a*. The collected lubricant flows inwardly within the tubes 96*a* and is by means of a pair of diametrically disposed U-shaped tubes 109 returned to the lubricant bath 110 at the inner surface of the peripheral engine housing wall 5 adjacent boiler chamber 1.

The force feed lubrication system utilizes a Pitot pump, such as shown in FIG. 3 of the drawings, of the type described and claimed in my U.S. Pat. 3,744,246 issued July 10, 1973. As shown, the Pitot pump comprises a radial passage 110 formed in the pendulum 71 having at its outer end an L-shaped scoop 111, the inlet end of which is immersed in the annular bath of lubricant extending circummferentially interiorly of the engine housing H and facing in the direction opposite the direction of rotation thereof.

Adjacent the inner end, the passage 110 divides into two angularly extending branch passages 112 and 113, respectively. The passage 112 conducts lubricant to the interior of the hub portion 63 for lubrication of the bearings 64 on the inner end of the engine shaft 9 and the branch passage 113 connects to the radial leg of an inverted L-shaped connector 114, the horizontal portion of which extends coaxially within the spur gear 60 of the fixed-ratio gear train, for example, as shown in FIG. 4 of the drawings. The engine shaft 38 is provided interiorly thereof with a coaxially extending lubricant bore 115 having radial passages 116 and 117 communicating outwardly therefrom for lubricating the engine shaft bearings 48 and 39, respectively, as well as the several gears in the fixed-ratio gear train.

Rotation of the engine housing H relative to the non-rotating torque anchor T operates to pump lubricant from the bath 110 inwardly of the scoop 111 and through the connecting passages and tubes to the bearings 39, 48 and 64, and the gear train, as described. Lubricant from the bearing 39 drains through radial passages 118 to a pair of diametrically disposed radial pipes or tubes 120 by means of which it is returned to the lubricant bath 110. Lubricant from the bearing 48 and the gear train drains into an annular collector ring 121 from which it is returned by a pair of diametrically disposed tubes 122 to the lubricant bath 110. Similarly, lubricant from the bearings 64 also drains into a collector ring 123 from which it is returned to the lubricant bath 110 by means of a pair of diametrically disposed radial tubes 124.

The temperature of the lubricant bath 110 usually is higher than the temperature of the expanding refrigerant portion of the fluid in the capillary tubes 93 and, accordingly, the portions of the tubes 93 passing through the lubricant bath preferably are thermally insulated from the lubricant, for example, by means of a circumscribing tubular sheath 125 closed at its opposite ends and filled with a suitable insulating material 126.

In operation of the apparatus, it will be apparent at start-up that there will be no pressure vapor generated by the boiler B to drive the expander PX, the compressor P and in turn the boiler-condenser-evaporator unit. Consequently, at start-up it is necessary to independently drive the boiler-condenser-evaporator unit at the designed predetermined speed of rotation to establish and maintain the liquid/vapor interface *i* in the boiler chamber 1 until the annular body of liquid in the boiler is heated to the temperature to produce the desired pressure vapor to drive the turbine 35. This may be accomplished, for example, by means of a starter motor M driving a pulley 128 fixed on the engine shaft 10 through a belt or chain 129. Means such as a clutch (not shown), can be provided for breaking the drive between motor M and pulley 128 when the engine attains normal operation, or the motor can continue to be driven by the rotating boiler-condenser-evaporator unit and shaft 10 to function as a generator operable, for example, for charging a battery that powers accessories such as the starter motor, lights and the like.

As previously stated, the partition 50 divides the interior of the engine housing H into two compartments X and Y that are at different pressures during operation of the apparatus. With reference to FIG. 3, the lefthand compartment Y operates at the lower pressure of the evaporator and the inlet to the compressor. On the other hand, the right hand compartment X operates at the high pressure of the compressor and diffuser discharge and the condenser C. Thus, in operation, refrigerant vapor in the housing compartment Y enters the compressor P through intake passages 47, is compressed, and discharged through the passage 49 into the high pressure compartment X where it combines with the turbine exhaust vapor discharge from the engine turbine through diffuser 56. This combined fluid in the engine compartment X enters the heat exchange tubes 76 of the condenser C where it is condensed by heat exchange with a cooling fluid discharged outwardly between the fins 75 of the condenser as previously described.

The condensate formed in the tubes 76 flows from the inner ends thereof and is collected in the annular chamber 82 where it is split or divided and supplied to the boiler through the radial tubes 84 and to the expander tubes 93 through the thimbles 89 of the feed systems A as previously described. When the condensate in the thimbles 89 rises to level of the inner ends of the radial tubes 92 it overflows into said tubes and to and through the associated capillary tubes 93 where it is expanded and supplied to the evaporator E. As the liquid in the boiler B is vaporized and discharged through the radial tubes 54 to the turbine, the liquid is depleted so that the level *i* moves radially and exposes the outer ends of the sensor tubes 85 thereby causing high pressure boiler vapor to flow radially inward through the sensor tubes 85 and tubes 86 to the manifold ring 87 and thence through tubes 91 into the thimbles 89.

Boiler pressure vapor entering the thimbles 89 increases the pressure in the interior thimble spaces 130 above the inner ends of the tubes 92 sufficiently to prevent the overflow of condensate into said tubes 92. This causes the condensate in the chamber 82 to increase in depth until the condensate overflows into the boiler feed tubes 84 thereby raising the boiler liquid level *i* radially inward to close the ends of the sensor tubes 85 and interrupt the flow of boiler pressure vapor to the thimbles 89. The boiler pressure vapor in the sensor tubes 85 is cooled by contact with the boiler feed tubes 84 returning cold liquid condensate to the boiler and the pressure vapor in the thimbles 89 is further chilled by the cold liquid in the thimbles thereby cooling the saturated vapor suffficiently to cause condensation thereof accompanied by a reduction in pressure in the thimble spaces 130 sufficient to permit resumption of overflow of liquid condensate into the inner ends of the tubes 92 and to the capillary expansion tubes 93.

This interplay between fluctuation of the boiler liquid level *i* to open and close the outer ends of the sensor tubes 85 and thereby control the division and flow of condensate from the chamber 82 to the boiler B and capillary expander tubes 93 is substantially continuous so that the surface level of the liquid in the boiler is automatically maintained substantially continuously at the level *i* shown in the drawings and the flow of the refrigerant portion of the condensate to and through the capillary expander tubes 93 is also substantially continuous.

A typical example of closed Rankine cycle rotary engine powered heating and cooling apparatus embodying the single fluid system of the present invention designed for an output of 4.6 hp at the turbine shaft 38, comprises a boiler B having a liquid level *i* diameter of 40 inches and an axial internal length sufficient to provide the heat input required to the boiler liquid from the combustion gases. The diameter of the boiler vapor expanded turbine at the blades 37 is of the order of 2.5 inches and the diameter of the compressor is designed to compress the refrigerant fluid from evaporator pressure to the condenser pressure. The fins of the condenser C have an outer diameter of 21.0 inches and an inner diameter of 17.4 inches. The axial length of the series of condenser fins 75 is 21.0 inches and the spacing between adjacent fins if 0.036 inches with the axes of the heat exchange tubes disposed at a radius of 9.4 inches from the rotation axis of the apparatus. The fins 95 of the evaporator have an outer diameter of 21.0 inches and an inner diameter of 17.4 inches. The axial length of the series of evaporator fins is 4.5 inches and the spacing between adjacent fins is 0.036 inches. The axially extending evaporator tubes **96, 96*a* are also disposed at a radius of 9.6 inches from the rotational axis of the apparatus. The boiler-condenser-evaporator assembly is rotationally driven at a speed of 1200 r.p.m. by the turbine through the fixed-ratio gear train in the direction opposite to rotation of the turbine rotor 44.** Using as the single boiler and refrigerant fluid 1,1,2-trichloro-1,2,2-trifluoroethane the specifications of a typical operation of the designed apparatus are as follows:

| | |
|---|---|
| Boiler temperature (°F.) | 370. |
| Boiler pressure (psia) | 331. |
| Boiler load (Btu/hr) | 80,800. |
| Turbine speed (rpm) | 42,000. |
| Rankine cycle efficiency | 0.20 |
| Condenser saturation temperature (°F.) | 130. |
| Condenser pressure (psia) | 18. |
| Condenser load (Btu/hr) | 94,000. |
| Condenser air flow (cfm) | 3,900. |
| Evaporator temperature (°F.) | 40. |
| Evaporator pressure (psia) | 2.7 |
| Evaporator load (Btu/hr) | 18,000. |

-continued

| | |
|---|---|
| Evaporator air flow (cfm) | 600. |

Figure 7:
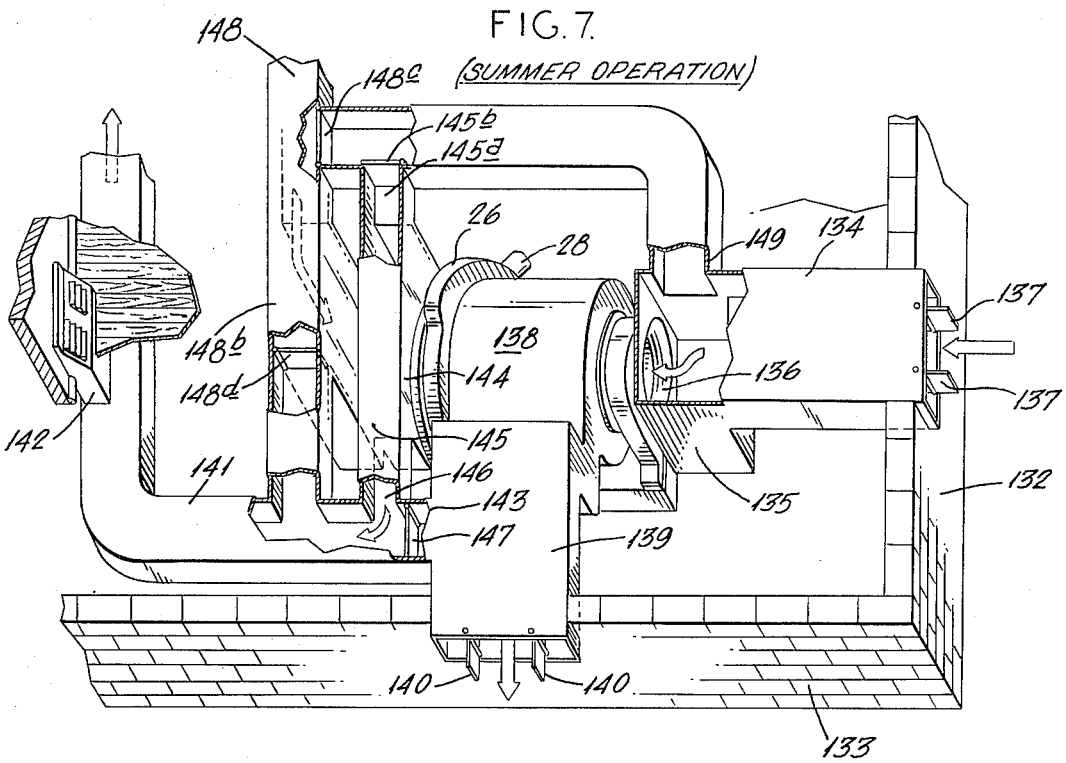
FIG. 7 is a perspective view showing the apparatus of the present invention with associated ducts for cooling or air-conditioning a building in the summer time or other warm temperature climate.
Figure 8:
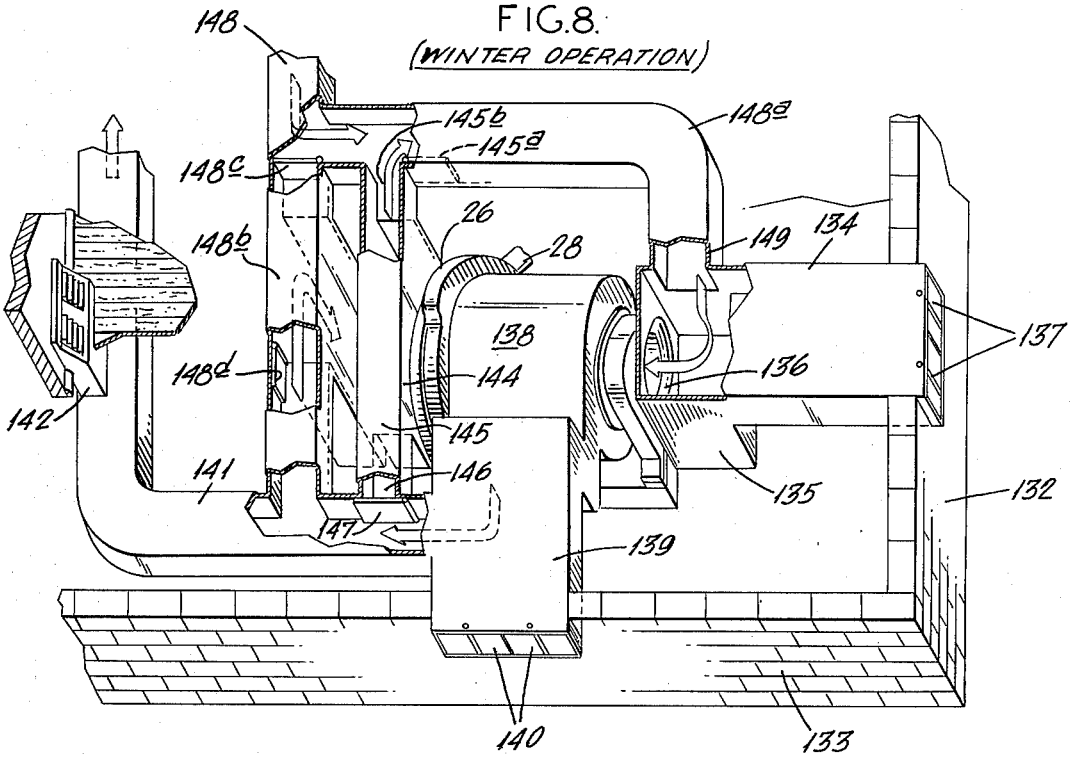
FIG. 8 is a view similar to FIG. 7 showing the duct arrangement for heating a building in the wintertime or other cold temperature climate.

The apparatus of the present invention is well suited for cooling or heating the interior of buildings, homes and other enclosed structures, and typical arrangements thereof for summer and winter operations are shown in FIGS. 7 and 8, respectively, of the drawings.

Referring to FIGS. 7 and 8, the apparatus embodying the invention is shown with associated ducts and valves arranged for cooling and heating a building, respectively. Preferably, the apparatus is located adjacent a wall or walls of the building for convenient access to the atmosphere outside the building such as, for example, adjacent the corner of two side walls 132 and 133 of a building, as shown.

In the arrangement shown, air from outside the building is supplied to the inlet of the rotary condenser C of the apparatus through a horizontal duct 134 that extends inwardly through the building wall 132 and connects at its inner end to an inlet housing 135 having an opening 136 to the condenser inlet. The outlet end of the duct 134 is provided with suitable valve closure means such as shutters 137 which may be opened, as shown, to admit outside air through the duct to the condenser, or closed to prevent the admission of outside air to the condenser.

A stationary housing or plenum chamber 138 circumferentially encloses the rotary condenser C of the apparatus and air admitted to the condenser C is discharged outwardly through the condenser fins 75 where it is heated by heat exchange with the fluid being condensed in the condenser tubes 76. An exhaust duct 139 for the heated air discharged into the plenum chamber 138 leads tangentially therefrom and then outwardly through the building wall 133 to the exterior of the building. The outlet end of the duct 139 is also provided with suitable valve closure means, such as shutters 140, for opening or closing the duct outlet to the outside atmosphere. A distribution duct 141, for conveying heated or cooled air from the apparatus to suitable outlets 142 appropriately located throughout the building, has an inlet thereto connected at 143 to the exhaust duct 139.

Similar to the condenser plenum chamber 138, the rotary evaporator E is also circumferentially enclosed within a stationary housing or plenum chamber 144 to receive the air discharged radially outward through the fins 95 of the evaporator during which it has been cooled by heat exchange with the condensed refrigerant in the evaporator tubes 96. The cooled air discharged to the plenum chamber 144 is delivered to a duct 145 that is connected at one end thereof to the distribution duct 141 through a side wall thereof as indicated at 146. Valve means, such as a shutter 147, is provided in the distribution duct 141 for selectively admitting air to the duct 141 from either the condenser exhaust duct 139 or the evaporator exhaust duct 145. For example, with the shutter 147 in the position shown in FIG. 7 disposed crosswise of the distribution duct 141, air is admitted from duct 145 to duct 141 and air from the condenser exhaust duct 139 is prevented from entering the duct 141. The other end of the duct 145 is connected to the return duct branch 148*a* through a side wall thereof, as indicated at 145*a*, and valve means, such as shutter 145*b* is provided for selectively admitting the cooled air from duct 145 to duct 148*a*.

Air distributed by the duct 141 and discharged throughout the interior of the building through one or more of the outlets 142 is returned to the apparatus by a return duct 148 that divides into two branches 148*a* and 148*b*, respectively, a valve, such as shutter 148*c* being provided for selectively admitting returning air to branch ducts 148*a* or 148*b* as desired. The branch duct 148*a* leads from the duct 148 and is connected into the fresh air inlet duct 134 through a side wall thereof as indicated at 149. The other branch duct 148*b* is connected to the fluid inlet chamber of the evaporator E and also to the air distribution duct 141, a valve, such as shutter 148*d* being provided for selectively controlling the flow of returning air to the evaporator inlet E or the air distribution duct 141 as desired.

Referring to FIG. 7 of the drawings, for cooling or air-conditioning the building in summer or other warm climate, the fresh air inlet shutters 137 are open as are the shutters 140 of the condenser exhaust duct 139, and the shutter 147 is positioned, as shown, to open the duct 145 and admit cooled air to the distribution duct 141 and close the latter to air from the condenser exhaust duct 139. Shutter 145*b* in duct 145 is closed thereby preventing discharge of cooled air through branch duct 148*a* into the branch duct 148*b*. Also, shutter 148*d* in duct 148*b* is closed and shutter 148*c* is positioned as shown, to close duct 148*a* and open duct 148*b* so that all air returning through duct 148 is conducted to the inlet of the evaporator.

In operation of the arrangement shown in FIG. 7, all of the heated air discharged from the condenser C is exhausted through duct 139 to the outside atmosphere and does not enter the distribution duct 141. On the other hand, all of the cooled air discharged from the evaporator E is delivered by duct 145 to the duct 141 and distributed thereby to the outlets 142 located throughout the building. The air discharged into the building is returned to the apparatus through the duct 148. Since the shutter 148*d* in branch duct 148*b* is closed, and shutter 148*c* is closed to branch duct 148*a* and open to branch duct 148*b*, all of the air returned by the duct 148 is delivered by branch duct 148*b* to the evaporator E where it is again cooled and recirculated through the building as described.

FOr winter or other cold climate operation as shown in FIG. 8, the fresh air inlet shutters 137 are closed as are the condenser external exhaust shutters 140, and the shutter 147 is positioned to close the duct 145 and allow all of the heated air from the duct 139 to enter the distribution duct 141. Also, the shutter 148*c* is closed to branch duct 148*b* and opened to branch duct 148*a* to admit return air from duct 148 into the condenser inlet duct 134. Thus, in operation, all of the heated air from the condenser C is discharged into the duct 141. A portion of the heated air is distributed to the building outlets 142 and the air returned by the duct 148 is delivered by branch duct 148*a* to the condenser inlet duct 134 to be again heated and recirculated as described. The balance of the heated air is conducted through branch duct 148*b* to the inlet of the evaporator and the cooled air from the evaporator discharged through duct 145 into the branch duct 148*a*.

By short-circuiting the evaporator air flow through the condenser as shown in FIG. 8 the evaporator temperature and pressure are raised and the condenser temperature and pressure are lowered. The reduced pressure rise across the refrigerant compressor combined with a decrease in compressor speed during winter operation reduces the compressor work load. The low pressure ratio, low speed compressor operation serves as an idle condition for the compressor during winter operation.

However, in winter operation as described, the amount of heat rejected by the condenser C and picked up by the air discharged therethrough may be somewhat less than normally would be required to heat a building for which the capacity of the refrigeration system is designed to adequately air-condition the building, and consequently increased heat input to the boiler may be necessary to provide adequate heating for winter or cold climate operation.

From the foregoing it will be apparent that the present invention provides a novel rotary closed Rankine cycle engine powered cooling and heating apparatus utilizing a single fluid for both engine power and refrigeration. The apparatus of the invention is of compact, unitary construction, quiet and efficient in operation, does not require high speed seals for separating portions of the apparatus operating at different pressures, and can be manufactured and shipped fully assembled charged with the single refrigerant and power fluid. The invention also provides apparatus as described that functions either as a space cooler or heater as desired and employs isenthalpic expansion of the refrigerant portion of the single fluid thereby supplying additional power to offset the load on the compressor while increasing the cooling capacity of the refrigerant.

While a particular embodiment of the present invention has been illustrated and described, it is not intended to limit the invention to such disclosures and it is contemplated that changes and modifications may be made to and incorporated in the apparatus within the scope of the following claims.

I claim:

1. Rotary closed Rankine cycle engine powered heating and cooling apparatus utilizing a single fluid for both engine power and refrigeration comprising a cylindrical housing mounted for rotation about the axis thereof including an internal boiler for the engine power portion of said single fluid, means for heating the fluid in said boiler to generate pressure power fluid vapor therein, means subdividing the interior of said rotatable housing to provide a high pressure fluid compartment and a low pressure fluid compartment, a first expander in said housing for expanding the pressure power fluid generated in the boiler and discharging the expanded fluid to the high pressure compartment of the housing, including a coaxial driving member rotatably driven at a first predetermined speed by said power fluid, a compressor rotatably mounted coaxially in the housing driven by said first expander driving member and operable to compress the refrigerant portion of the single fluid in said low pressure fluid compartment and discharge the compressed refrigerant to said high pressure compartment of the housing, a condenser mounted coaxially of the housing and rotatable therewith comprising a plurality of axially spaced radial annular fins having heat exchange tubes extending longitudinally therethrough an communicating with the high pressure compartment of the housing to receive and condense therein the power and refrigerant portions of said single fluid discharged from the first expander and compressor, a second expander in said housing for expanding the refrigerant portion of the fluid condensed in said condenser, means for dividing and supplying the liquid condensed in the condenser to the boiler and to said second expander in predetermined proportions, an evaporator mounted coaxially of the housing and rotatable therewith comprising a plurality of axially spaced annular fins having heat exchange tubes extending longitudinally therethrough and communicating with the low pressure compartment of the housing to receive the vaporize therein the refrigerant portion of the fluid discharged from said second expander and return the vaporized refrigerant portion to the low pressure compartment of the housing.

and means operable to rotationally drive the housing, condenser and evaporator as a unit at a second predetermined speed operable to cause a gaseous heat exchange fluid to be conveyed and accelerated by viscosity shear forces outwardly between the fins of the condenser and evaporator to the velocity providing optimum heat exchange between said gaseous fluid and the power and refrigerant portions of the fluid in the heat exchange tubes of the condenser and evaporator.

2. Apparatus as claimed in claim 1 wherein the means for supplying to the boiler the power fluid portion of the liquid condensed in the condenser is constructed and operable to supply said liquid to the boiler at the rate to maintain a constant predetermined liquid level in said boiler, the balance of the liquid condensed in said condenser being delivered to the second expander.

3. Apparatus as claimed in claim 2 wherein the means for supplying condensed liquid to the boiler comprises a plurality of radial feed tubes having their outer ends immersed in the boiler liquid, and a plurality of radial sensor tubes having their outer ends disposed at the desired level of liquid in the boiler and cooperable with said feed tubes automatically to maintain the level of liquid in the boiler substantially continuously at said desired level.

4. Apparatus as claimed in claim 1 wherein the scond expander for the refrigerant portin of the liquid condensed in the condenser is constructed and operable in response to the pressure drop across said expander between the condenser and evaporator automatically to establish and maintain capacity balance in the refrigerant system.

5. Apparatus as claimed in claim 4 wherein the means for supplying condensed liquid to the second expander comprises a plurality of feed systems each including means defining a chamber, means for supplying condensed liquid to said chamber, and means for supplying liquid from the chamber to said second expander.

6. Apparatus as claimed in claim 1 wherein the means for supplying to the boiler the power fluid portion of the liquid condensed in the condenser is constructed and operable to supply said liquid to the boiler at the rate to maintain a constant predetermined liquid level in said boiler, the balance of the liquid condensed in said condenser being delivered to the second expander, and said second expander is constructed and operable in response to the pressure drop across the second expander between the condenser and evaporator automatically to establish and maintain capacity balance in the refrigerant system.

7. Apparatus as claimed in claim 4 wherein the means for supplying condensed liquid to the boiler comprises a plurality of radial feed tubes having their outer ends immersed in the boiler liquid, and a plurality of radial sensor tubes having their outer ends disposed at the desired level of liquid in the boiler and operable automatically to maintain the level of liquid in said boiler at said desired level; the means for supplying condensed liquid to the second expander comprises a plurality of feed systems each including means defining a chamber, means for supplying condensed liquid to said chamber, and means for supplying liquid from the chamber to said second expander; and fluid connections are provided between the sensor tubes and the chambers of said feed systems cooperable therewith automatically to supply condensed liquid through said feed systems to the second expander substantially at the rate required to establish and maintain capacity balance in the refrigerant system.

8. Apparatus as claimed in claim 1 wherein the second expander comprises a plurality of capillary tubes equally spaced circumferentially of the housing and rotatable therewith, the length of said capillary tubes being correlated to the internal flow area thereof and to the number of said tubes to establish and maintain capacity balance in the refrigerant system in response to the pressure drop across said capillary tubes.

9. Apparatus as claimed in claim 1 wherein the means for rotationally driving the housing, condenser and evaporator as a unit comprises an occluded fixed-ratio gear train mounted coaxially within the housing and connected between the power fluid expander driving member and said housing, and torque anchor means cooperable with the occluded gear train opposing the reaction torque generated thereby so that the full power output of the power fluid expander is transmitted directly to the compressor and rotary housing.

10. Apparatus as claimed in claim 9 wherein the rotary housing includes a sump compartment for containing an annular bath of lubricant and the torque anchor means to non-rotatable with the housing and includes pump means operable to pump lubricant inwardly from said annular bath to the expander driving member to lubricate same.

11. Apparatus as claimed in claim 10 comprising means for returning to the low pressure compartment of the housing lubricant that migrates into the refrigerant system and collects in the evaporator tubes.

12. Apparatus as claimed in claim 1 wherein the axial spacing between adjacent annular fins of the condenser is correlated to the speed of rotation thereof and the kinematic viscosity of the cooling fluid to provide a Taylor number operable at the ratio of the inner to outer radii of the fins to convey and accelerate said cooling fluid by viscosity shear forces spirally outward between the fins substantially to the velocity providing optimum heat exchange between the cooling fluid and the fluid in said heat exchange tubes.

13. Apparatus as claimed in claim 1 wherein the axial spacing between adjacent annular fins of the evaporator is correlated to the speed of rotation thereof and the kinematic viscosity of the cooling fluid to provide a Taylor number operable at the ratio of the inner to outer radii of the fins to convey and accelerate said cooling fluid by viscosity shear forces spirally outward betwen the fins substantially to the velocity providing optimum heat exchange between the cooling fluid and the fluid in said heat exchange tubes.

14. Apparatus as claimed in claim 1 wherein the axial spacing between adjacent annular fins of the condenser and evaporator is correlated to the speed of rotation thereof and the kinematic viscosity of the cooling fluid to provide a Taylor number operable at the ratio of the inner to outer radii of the fins to convey and accelerate said cooling fluid by viscosity shear forces spirally outward between the fins substantially to the velocity providing optimum heat exchange between the cooling fluid and the fluid in said heat exchange tubes of the condenser and evaporator.

15. Cooling and heating apparatus as claimed in claim 14 comprising a fluid inlet duct connected to the inlet to the condenser fluid chamber, a housing defining a plenum chamber enclosing the condenser for receiving heated fluid discharged outwardly through the condenser fins, an exhaust duct connected to the condenser plenum chamber to receive heated fluid therefrom, a fluid distribution duct connected to said exhaust duct for conducting heated fluid therefrom to a remote zone, a return duct from said zone terminating in a first branch duct connected to said air inlet duct to the condenser chamber and a second branch duct connected to the fluid inlet chamber of the evaporator and to said air distribution duct, a housing defining a plenum chamber enclosing the evaporator for receiving therefrom cool fluid discharged outwardly through the evaporator fins, a cool fluid duct connected to said evaporator plenum chamber for receiving cool fluid therefrom, said cool fluid duct also being connected to said first return branch duct and to said distribution duct, valve means selectively operable for controlling the flow of fluid respectively from said exhaust duct and said cool fluid duct to the distribution duct, and valve means selectively operable for controlling fluid flow from said return duct to the said first and second branch ducts and between the latter and said cool fluid duct and fluid distribution duct.

16. Cooling and heating apparatus as claimed in claim 1 comprising a fluid inlet duct connected to the inlet to the condenser fluid chamber, a housing defining a plenum chamber enclosing the condenser for receiving heated fluid discharge outwardly through the condenser fins, an exhaust duct connected to the condenser plenum chamber to receive heated fluid therefrom, a fluid distribution duct connected to said exhaust duct for conducting heated fluid therefrom to a remote zone, a return duct from said zone terminating in a first branch duct connected to said air inlet duct to the condenser chamber and a second branch duct connected to the fluid inlet chamber of the evaporator and to said air distribution duct, a housing defining a plenum chamber enclosing the evaporator for receiving therefrom cool fluid discharged outwardly through the evaporator fins, a cool fluid duct connected to said evaporator plenum chamber for receiving cool fluid therefrom, said cool fluid duct also being connected to said first return branch duct and to said distribution duct, valve means selectively operable for controlling the flow of fluid respectively from said exhaust duct and said cool fluid duct to the distribution duct, and valve means selectively operable for controlling fluid flow from said return duct to said first and second branch ducts and between the latter and said cool fluid duct and fluid distribution duct.

* * * * *

UNITED STATES PATENT OFFICE

CERTIFICATE OF CORRECTION

PATENT NO. : 3,962,874

DATED : June 15, 1976

INVENTOR(S) : William A. Doerner

It is certified that error appears in the above-identified patent and that said Letters Patent are hereby corrected as shown below:

Column 3, line 23 --nozzle 23 at the required rate and pressure, and air for mixture-- should be inserted after "a".

Column 4, line 37 "fluid-right" should read --fluid-tight--.

Column 4, line 48 "fomr" should read --from--.

Column 4, line 58 "flixedly" should read --fixedly--.

Column 5, line 13, the comma at the end of line 13 should be deleted.

Column 6, line 24 "adjacnet" should read --adjacent--.

Column 10, line 28 "circummferentially" should read --circumferentially--.

Column 12, line 34 "expanded" should read --expander--.

Column 15, line 65 "an" should read --and--.

Column 16, line 14 "the" (first occurrence) should read --and--.

Column 17, line 43 "to" should read --is--.

Signed and Sealed this

Fourteenth Day of September 1976

[SEAL]

*Attest:*

RUTH C. MASON
*Attesting Officer*

C. MARSHALL DANN
*Commissioner of Patents and Trademarks*